US012241193B2

(12) United States Patent
Doukakis

(10) Patent No.: US 12,241,193 B2
(45) Date of Patent: Mar. 4, 2025

(54) METHOD FOR DISPLAYING AND EDITING THE SEQUENCE OF SAME COLORED PARTS OF AN EMBROIDERY DESIGN

(71) Applicant: DRAWSTITCH INTERNATIONAL LIMITED, Limassol (CY)

(72) Inventor: Ioannis Doukakis, Limassol (CY)

(73) Assignee: DRAWSITITCH INTERNATIONAL IIMITED, Limassol (CY)

( * ) Notice: Subject to any disclaimer, the term of this patent is extended or adjusted under 35 U.S.C. 154(b) by 36 days.

(21) Appl. No.: 18/378,555

(22) Filed: Oct. 10, 2023

(65) Prior Publication Data

US 2024/0133095 A1 Apr. 25, 2024

Related U.S. Application Data

(60) Provisional application No. 63/414,896, filed on Oct. 10, 2022.

(51) Int. Cl.
*D05C 5/04* (2006.01)

(52) U.S. Cl.
CPC ..... *D05C 5/04* (2013.01)

(58) Field of Classification Search
CPC ..... D05B 19/04; D05B 19/02; D05B 19/081; D05C 5/04; D05C 5/02; D05C 5/00
USPC ..... 700/134, 136, 137, 138
See application file for complete search history.

(56) References Cited

U.S. PATENT DOCUMENTS

| | | | | | |
|---|---|---|---|---|---|
| 5,896,822 | A * | 4/1999 | Futamura | D05B 19/08 | 112/102.5 |
| 5,954,004 | A * | 9/1999 | Futamura | D05B 19/10 | 112/102.5 |
| 6,253,695 | B1 * | 7/2001 | Chan | D05B 19/08 | 112/475.19 |
| 6,732,008 | B2 * | 5/2004 | Bailie | D05C 5/04 | 112/102.5 |
| 7,457,683 | B2 * | 11/2008 | Bailie | D05B 19/08 | 700/137 |
| 2002/0043203 | A1 * | 4/2002 | Laufer | D05B 19/08 | 112/475.19 |

FOREIGN PATENT DOCUMENTS

| | | | | | |
|---|---|---|---|---|---|
| GB | 2334264 | A * | 8/1999 | D05B 19/08 | |
| JP | H05123471 | A * | 5/1993 | | |
| JP | H10113483 | A * | 5/1998 | | |
| JP | 2852930 | B2 * | 2/1999 | D05B 19/12 | |
| JP | H11197380 | A * | 7/1999 | | |
| JP | H11197381 | A * | 7/1999 | | |

* cited by examiner

*Primary Examiner* — Danny Worrell
(74) *Attorney, Agent, or Firm* — John Alumit

(57) ABSTRACT

In the case of an embroidery image containing a plurality of individual parts, where at least two individual parts are to be stitched in the same color, an initial sequence is first generated by software of the individual parts to bear the same color. This is done by the user who clicks on the individual parts to bear the same color and the creation of a list corresponding to the selected individual parts. Then, the user is able to rearrange that sequence by drawing new arrows on the embroidery image based on the proximity of the individual parts to each other in order to make stitching less visible on the embroidered product and to reduce the trim time in the embroidery process.

10 Claims, 9 Drawing Sheets

METHOD FOR DISPLAYING AND EDITING THE SEQUENCE OF SAME COLORED PARTS OF AN EMBROIDERY DESIGN

CROSS-REFERENCE TO RELATED APPLICATION

This present application claims the benefit of Provisional Patent Application No. 63/414,896 filed on Oct. 10, 2022.

FEDERALLY SPONSORED RESEARCH

Not Applicable

SEQUENCE LISTING OR PROGRAM

Not Applicable

BACKGROUND

In machine embroidery a design is stitched by an embroidery machine stitch by stitch. As an embroidery design is usually comprised of lots of individual parts, the sequence in which these parts are sent to the embroidery machine is very important as explained below.

Contrary to printing, sequence is important even if the objects do not overlap. The embroidery machine embroiders the design using a continuous thread. When the embroidery must move from one part to another, non-adjoining, part, an embroidery software has two choices:

a) Make a connecting stitch and allow the thread to be visible between two non-adjoining parts—However, in this case, the embroidery would not look good if the connecting stitch is too long that it interferes with the symmetry or outline of the design or parts of it. This happens when the length of a connecting stitch exceeds 1.0-2.5 mm in length; or b) Instruct the machine to trim the thread before proceeding with embroidering the next, non-adjoining, part of the design. This approach results in an aesthetically pleasing embroidery output, but repeated thread trims slow down production and wear down parts of the embroidery machine.

To optimize the sequence, computer software can instruct the embroidery machine to embroider individual parts of a design, to avoid unnecessary movements of the embroidery hoop, and to avoid unnecessary thread trimmings. This would decrease production time, as well as minimize stretching and puckering of the fabric, which in turn results in a higher quality of embroidery.

Each embroidery software has its own set of rules regarding the sequence it instructs the embroidery machine to embroider the individual parts of a design. Nevertheless, because embroidery software cannot automatically judge if something looks nice or not, embroidery software normally allows users to customize the sequence further based on their own expertise and preferences. Usually individual parts that are close together should have a connecting stitch and parts far away do not. The threshold of closeness is up to the user and depends on the quality of the design made. Individual parts between 1 to 3 mm typically have a connecting stitch.

The challenge with embroidery software, therefore, is to display a sequence that allows the user to edit the sequence of individual parts of a design, even if the individual parts do not overlap.

Known are embroidery software that provide the following tools (commands) to allow a user to edit an embroidery sequence that the software first suggests:

a) "Bring to front", which sends one or more individual parts of the design to the end of the design;

b) "Send to back", which sends one or more individual parts of the design to the start of the design;

c) "Bring forward", which makes one individual part of the design embroider after its next individual part; and d) "Send backward", which makes one individual part of the design embroider before its previous individual part.

The embroidery software then shows a strip of icons, usually called "sequence manager," "film," or "filmstrip," as a visual aid for users to perform the afore-mentioned customized edits to the sequence, thus visually representing the individual parts of the design, one by one (one individual part per icon). A list can be shown either horizontally or vertically in the work area of the embroidery software and represents the current sequence the embroidery design has. An example is shown in FIG. 4. Usually, the left-most or top-most icon is the first to get embroidered.

A complete embroidery design may contain tens or hundreds of individual parts, though. FIG. 1, for example, contains 183 individual parts using 5 separate colors.

Furthermore, when changing color threads, the machine must trim the previous thread before it can change to a different color thread. A modern embroidery machine, may require more than 10 seconds to execute a thread trim. The extreme case of trimming between all 183 pieces, as in FIG. 1, would result in more than 1,830 seconds (183×10), which is more than half an hour extra time on the machine.

Therefore, in FIG. 1, finding a correct sequence of parts, and selecting entry and exit points of the parts in such a way that would make connecting stitches invisible or less apparent while reducing the necessary trim time to nearly zero, would save approximately half an hour of embroidery time. Even if a few trims remain in the design of FIG. 1, it could still reduce embroidery time by almost half an hour.

The current method therefore addresses all the shortcomings of existing embroidery software tools when working within a sequential group of embroidery design parts that share the same color (for example, yellow in FIG. 1), which is the case in many embroidery designs and which are the most difficult ones to address.

SUMMARY

The invention relates to the process of embroidery involving software, a computer pointing device (mouse) and an embroidery machine, and applies to embroidery images comprised of a plurality of individual parts, wherein at least two parts are the same color. The goal is to make stitches invisible or less apparent while at the same time reducing the trim time of the embroidery process.

The methodology involves displaying and intuitively editing the entry points, exit points and sequence of sequential same-colored individual parts of an embroidery image using a computer pointing device and computer software. First, a user uploads an embroidery image to a computer to display the image on a computer screen. Then, user clicks on a first individual part of the embroidery image, and the embroidery software creates a list of same color individual parts by clicking on other individual parts of the embroidery design that share the same color. An embroidery software either automatically creates an initial sequence of embroidery, or the user creates an initial sequence of embroidery using embroidery software manually, for the same color individual parts. The software tool of the present invention then illustrates the initial sequence on the embroidery image by way of arrows from each same color individual part to the next same color individual part, as shown in FIGS. 5 and 10. Said arrow starts at an entry point for the same color individual parts, leaves from exit points of each same color individual part, and points to the next same color individual part, in the order of the initial sequence.

Next, the user re-arranges the initial sequence of embroidery by drawing a new arrow on the embroidery image, as shown in FIGS. 11 and 13, by clicking on one same color individual part and dragging it to another same color individual part based on closeness as well as the user's preferences. Alternatively, the user may instruct the computer software to trim an arrow so that stitches on the resulting embroidered product are not visible, or are less apparent, when an embroidery machine stitches the embroidered product.

Once the initial sequence has been re-arranged for the same color individual parts, the user could then repeat the same process for another set of same color individual parts of the embroidery image to be stitched in a different color.

DRAWINGS

Figure 3:
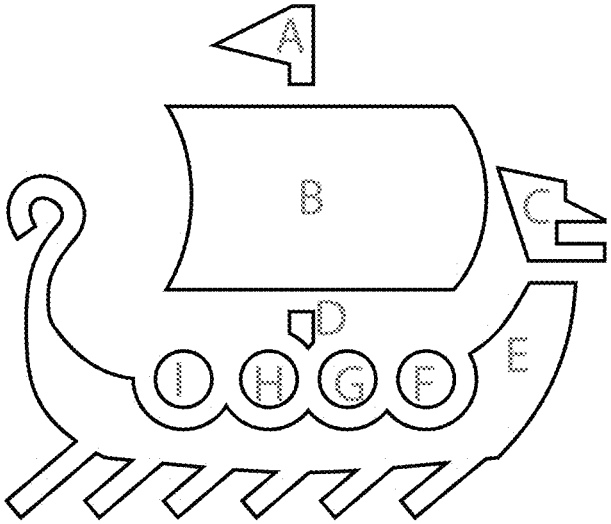

FIG. 3 lists individual parts A-I to be embroidered in the same color.

Figure 4:
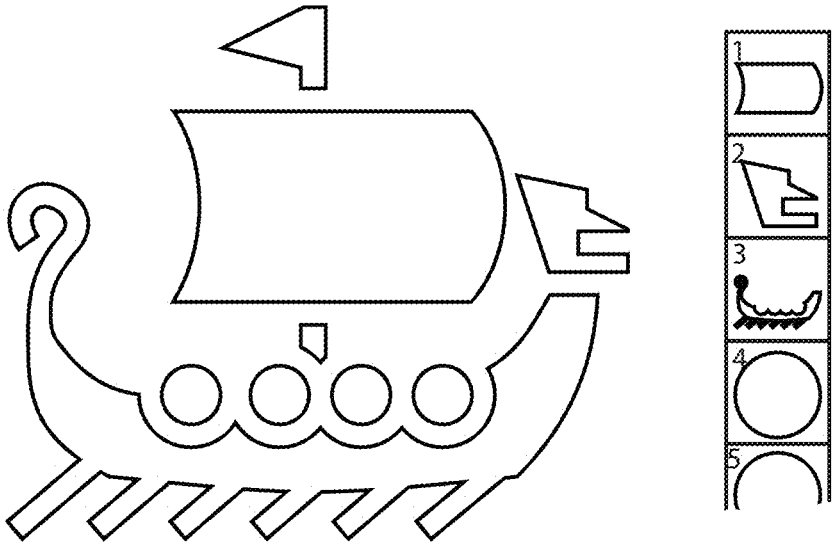

FIG. 4 illustrates a list of the individual parts of the embroidery image corresponding to the individual parts that would bear the same color.

Figure 5:
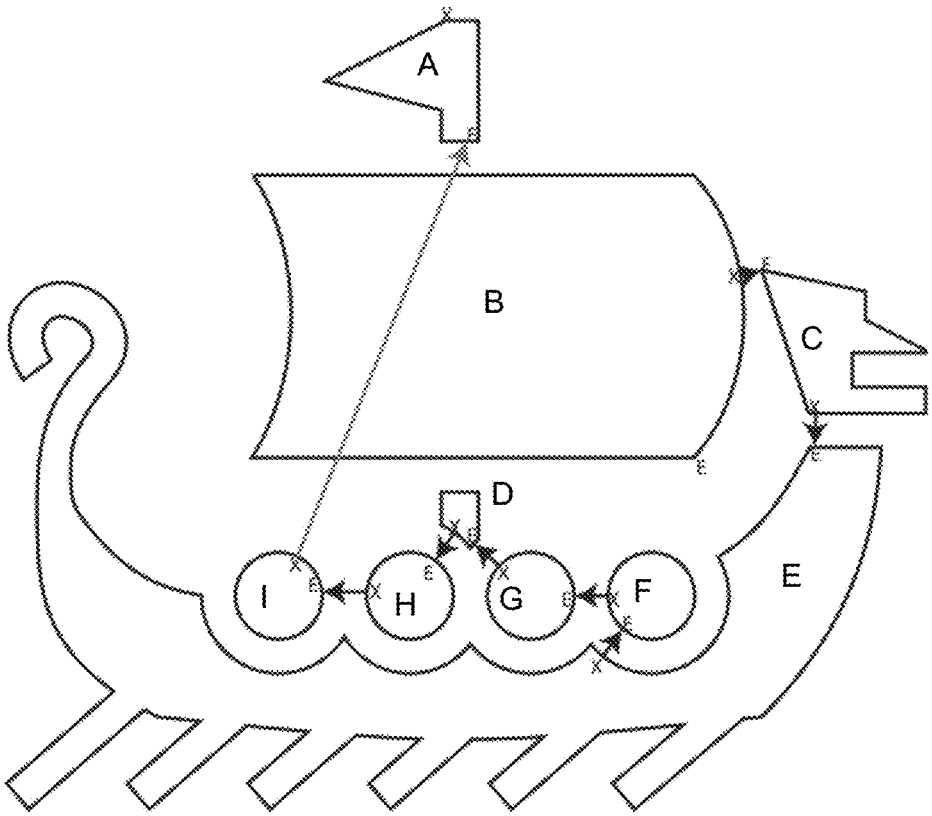

FIG. 5 illustrates an initial sequence of embroidery using arrows between an exit point ("X") and an entry point ("E").

Figure 6:
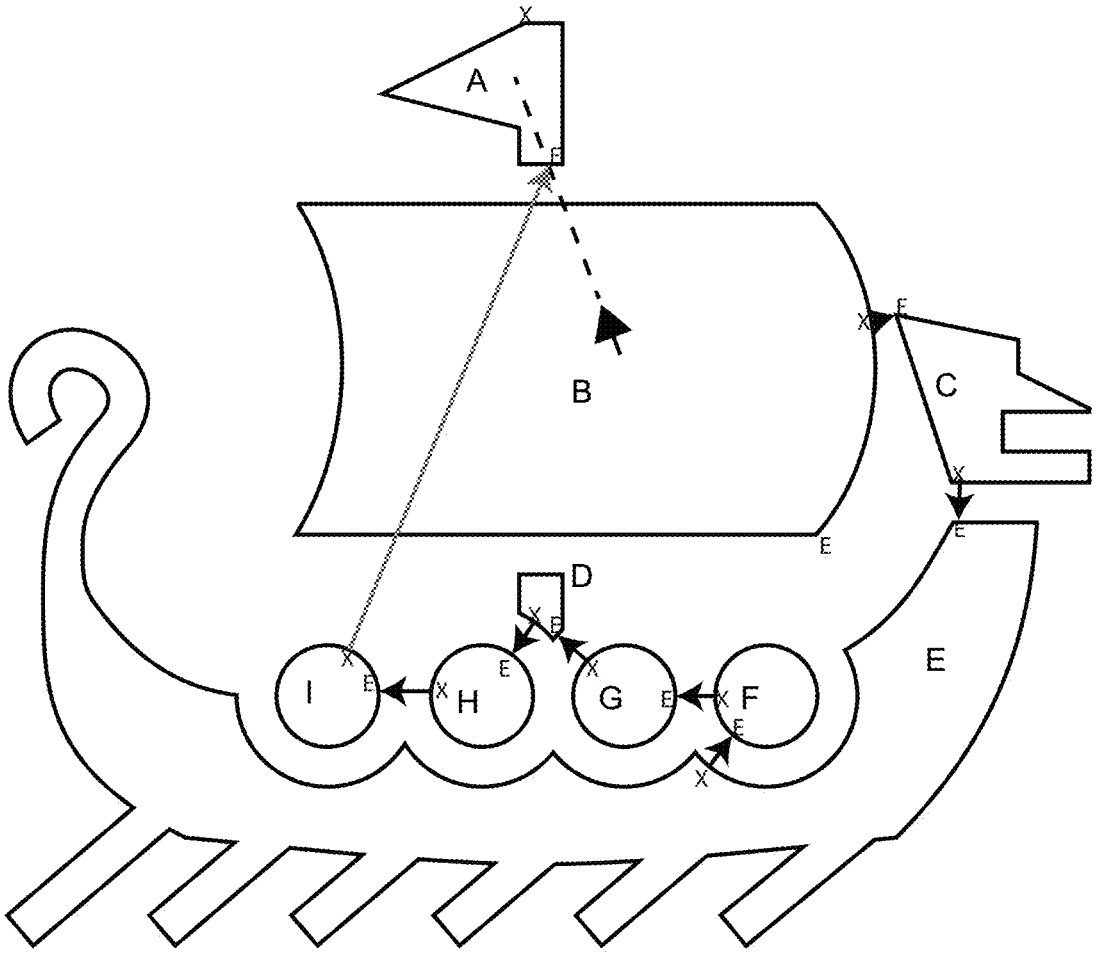

FIG. 6 illustrates a rearrangement of the initial sequence be creation of a new arrow between two individual parts.

Figure 7:
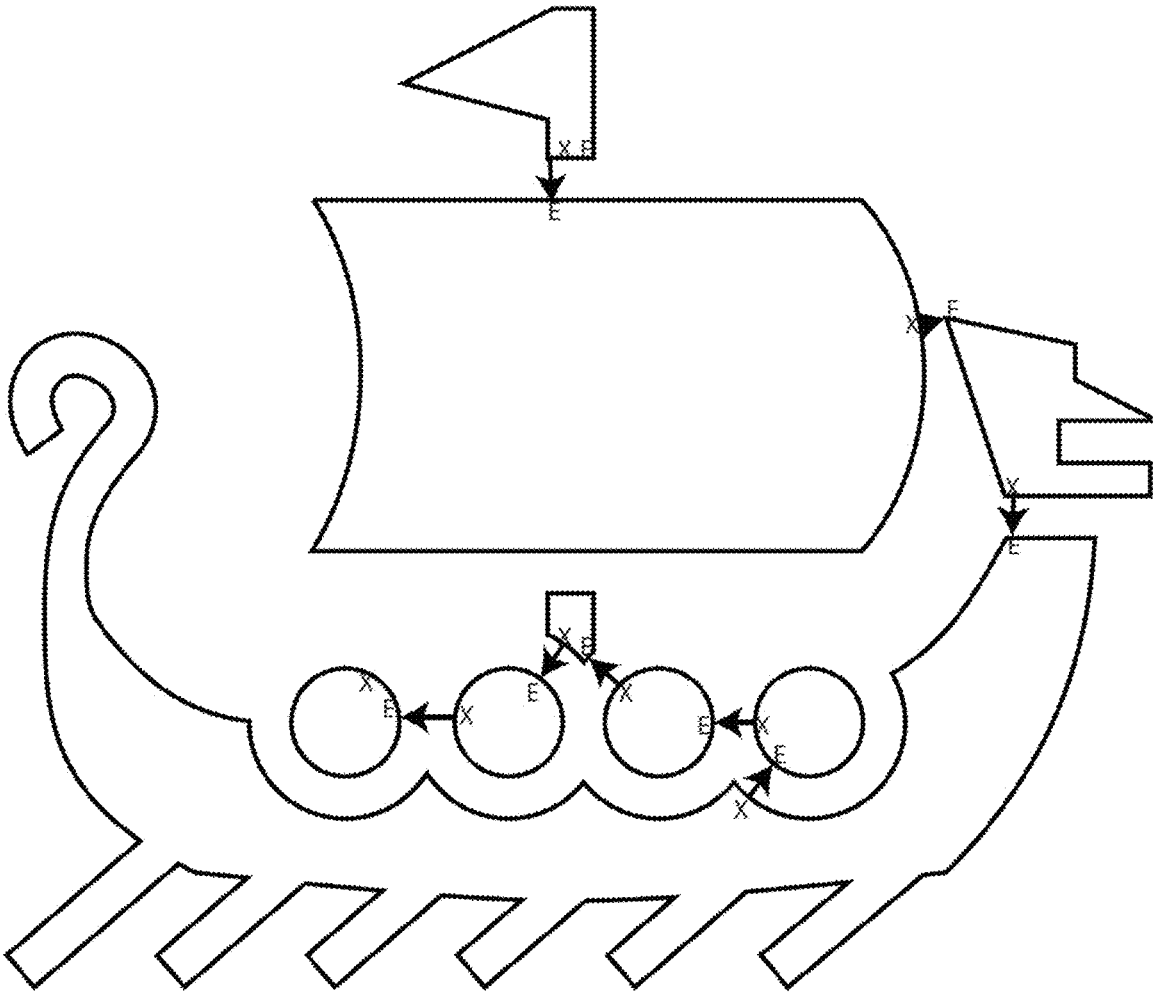
Figure 8:
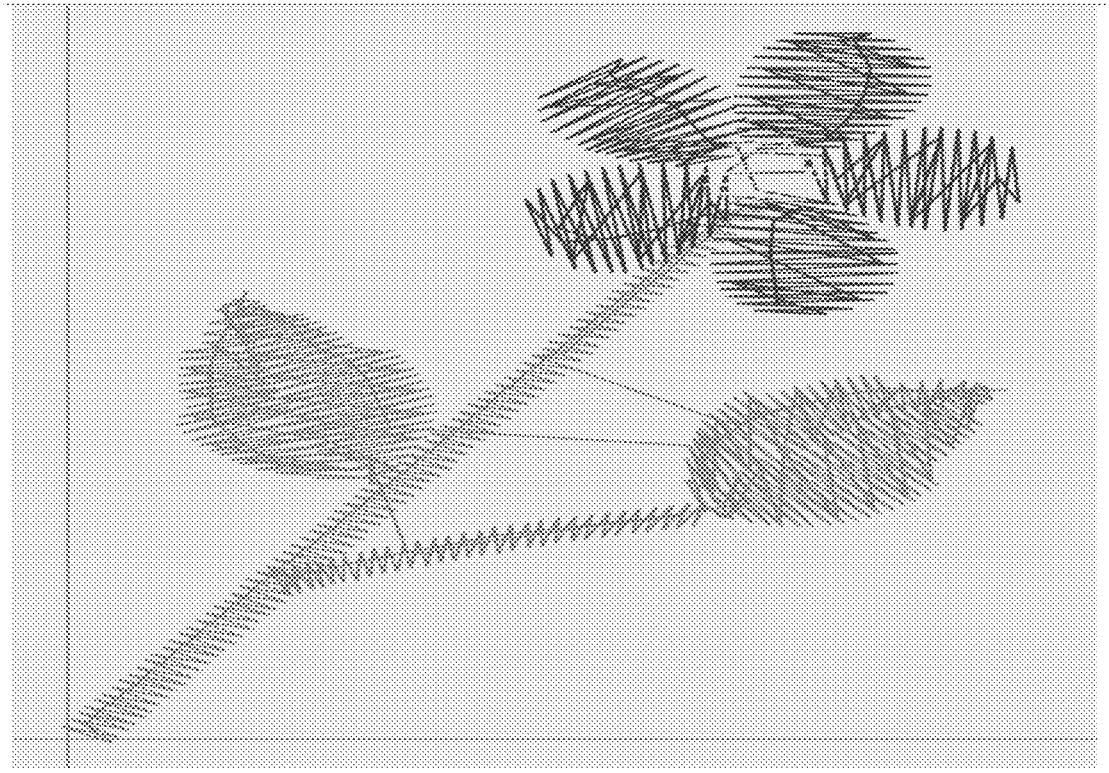

FIG. 7 illustrates an example of a new sequence of stitching based on closeness of the individual parts FIG. 8 illustrates an example of a flower containing green individual parts, red individual parts, and a yellow part.

Figure 9:
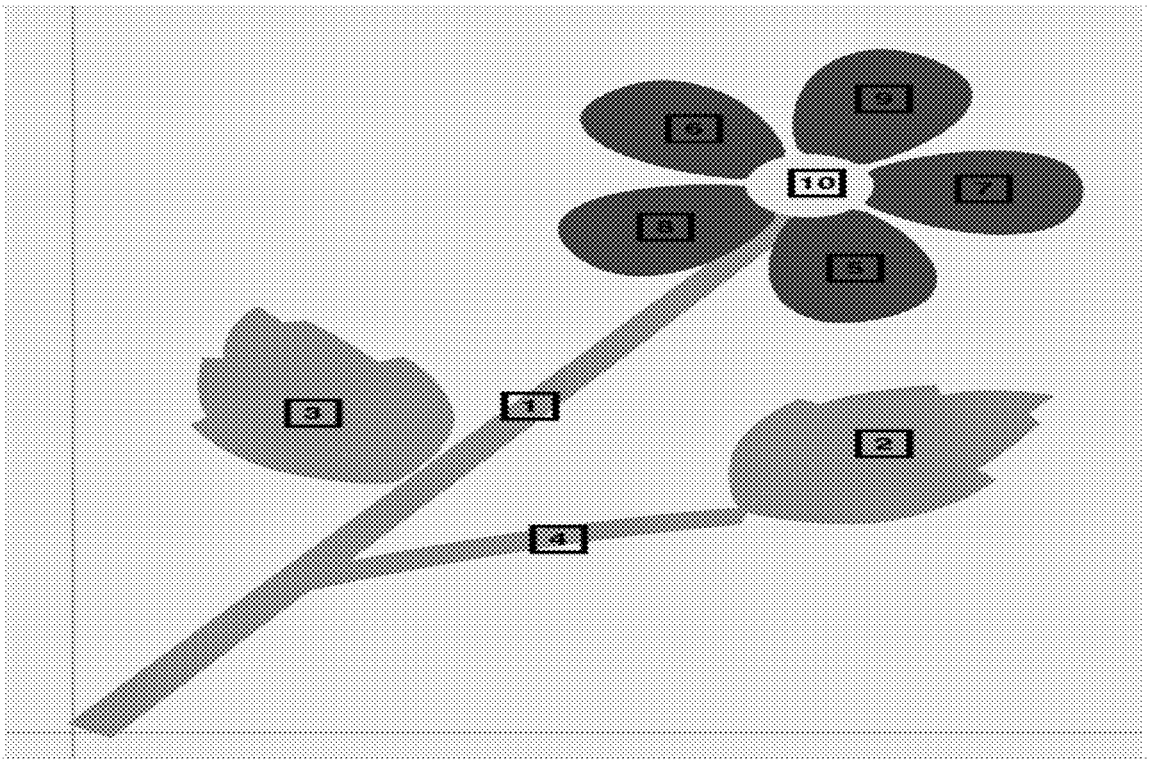

FIG. 9 illustrates the initial sequence of embroidery for the flower using numbers 1-10.

Figure 10:
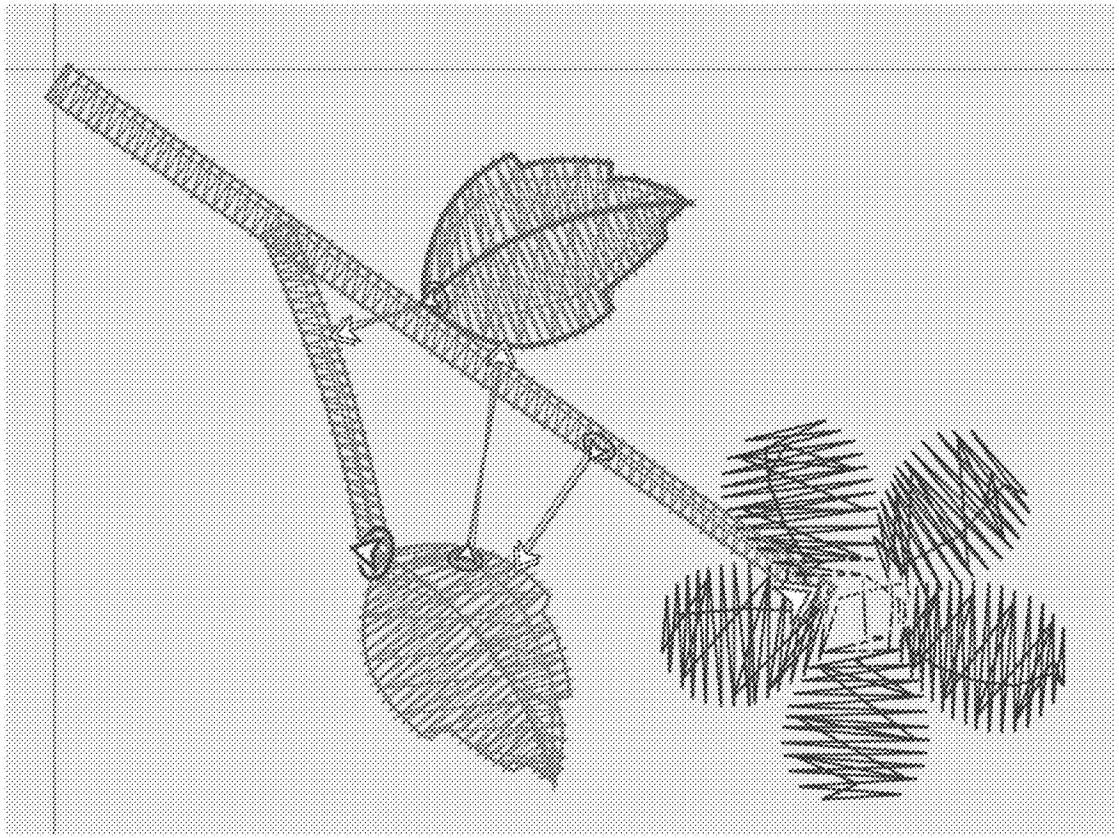

FIG. 10 illustrates the initial sequence of embroidery for the green individual parts using arrows, and indicating an entry point and exit points.

Figure 11:
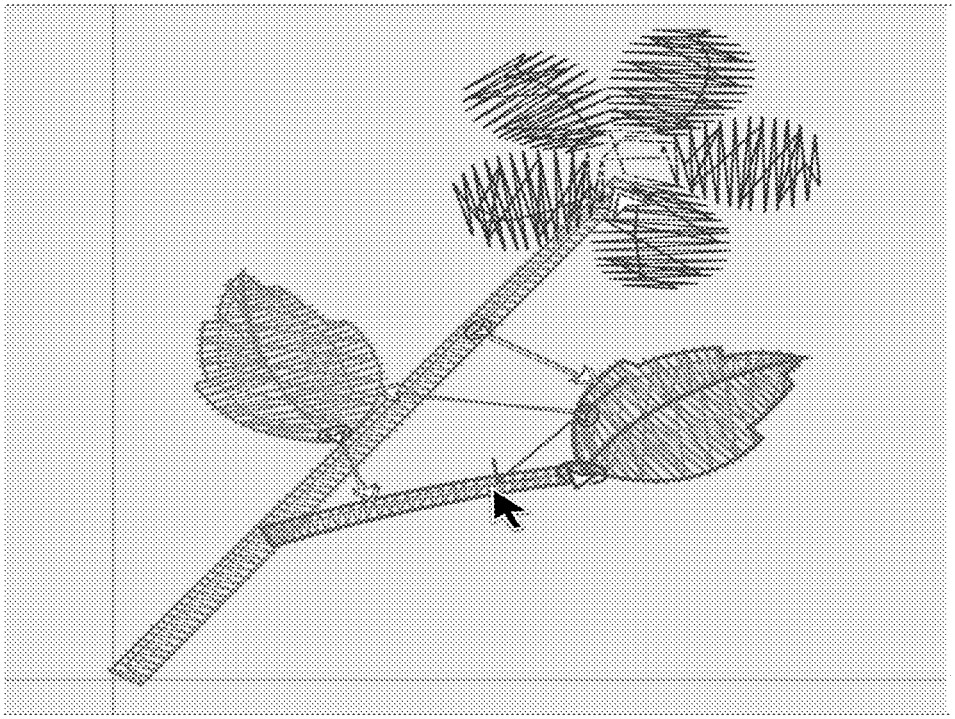

FIG. 11 illustrates the process of rearranging the initial sequence by drawing a new (red) arrow from one same color individual part to another same color individual part (i.e., dragging the right leaf to the right stem using a mouse/cursor).

Figure 12:
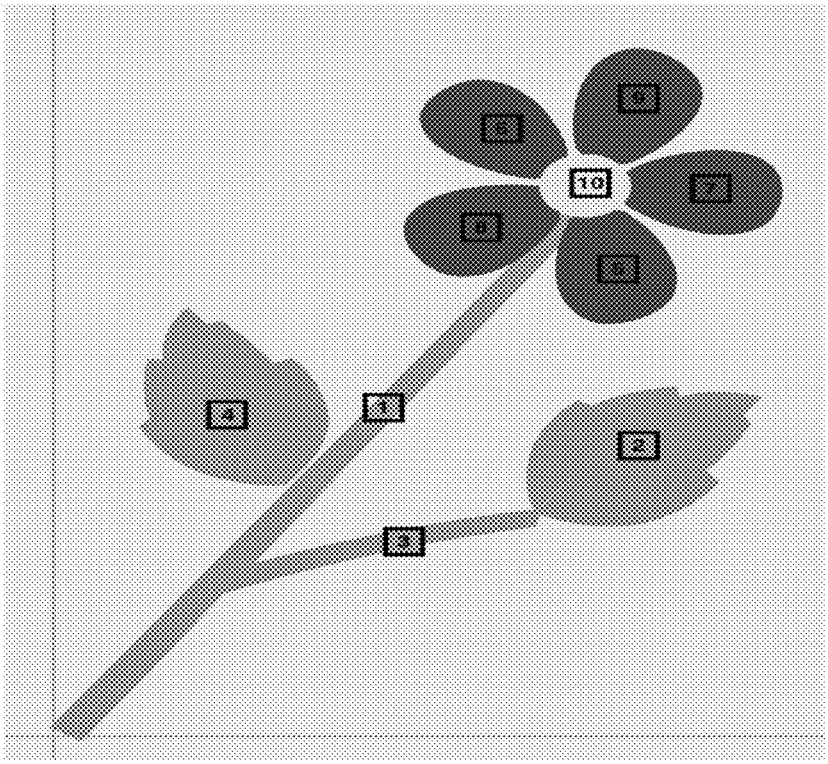

FIG. 12 illustrates a secondary sequence of embroidery based on a rearranging of the initial sequence.

Figure 13:
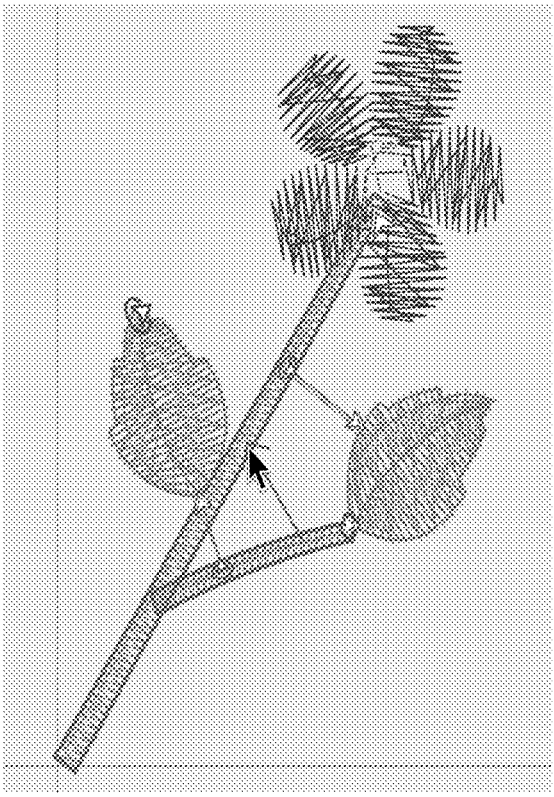

FIG. 13 illustrates another action of rearranging the secondary sequence of embroidery by dragging the right stem to the left stem (shown in a red arrow) in order to achieve an optimal sequence of embroidery.

Figure 14:
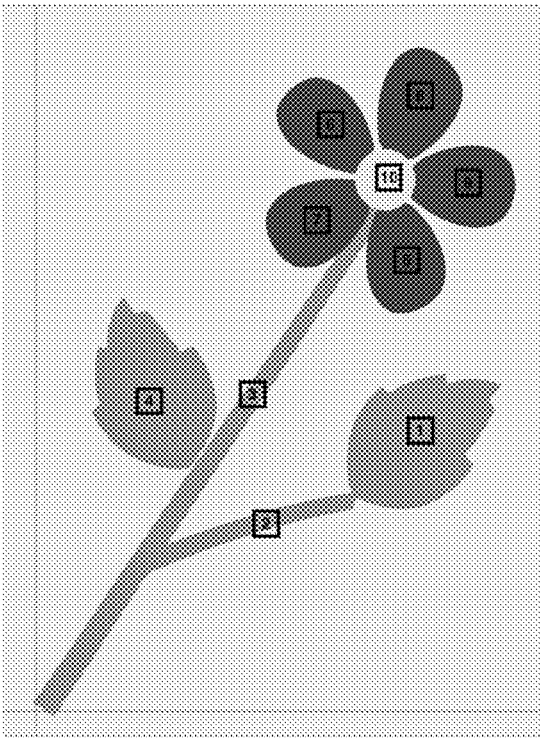

FIG. 14 illustrates the final an optimal sequence of embroidery chosen by the user.

DESCRIPTION

Figure 1:
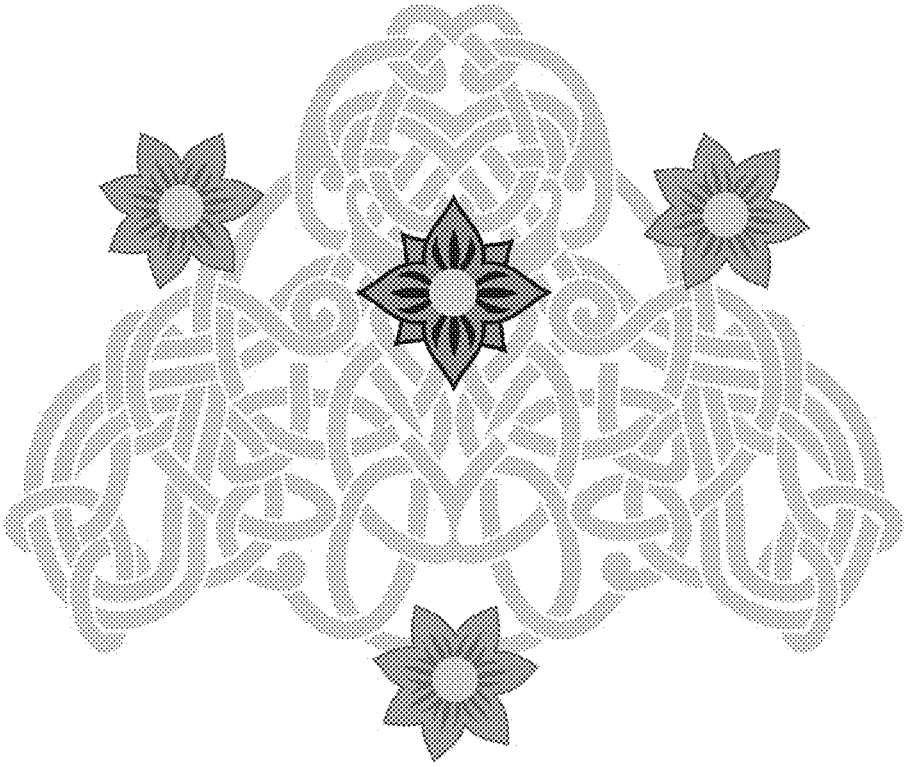
FIG. 1 is an example of an embroidery image containing 183 individual parts using 5 separate colors.

FIG. 1 is an example of an embroidery image containing 183 individual parts and 5 separate colors (yellow, light turquoise, dark turquoise, light purple, and dark purple). The present methodology applies to same color individual parts only, for example, the color yellow and the numerous individual curvy lines and flower centers depicted in the color yellow.

Within such a context, the invention is directed to choosing a sequence of individual parts to be colored in the same color and selecting entry and exit points for each individual part, such that connecting stitches would be invisible or less apparent, while reducing trim time.

Figure 2:
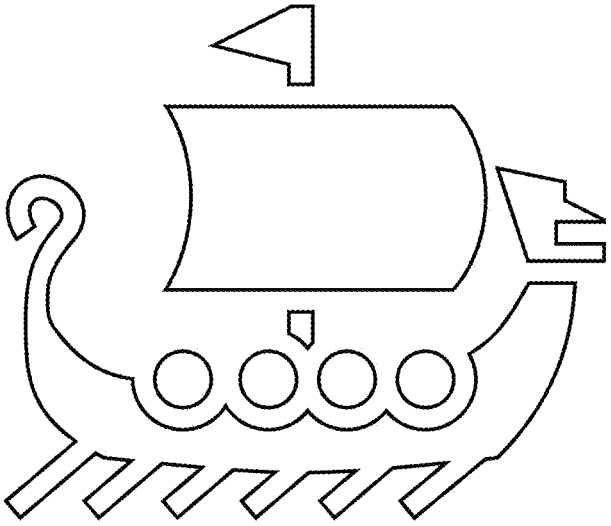
FIG. 2 shows a portion of an embroidery image of a sail boat to be stitched in the same color.

To simplify matters, FIG. 2 depicts a more simpler design, illustrating a sail boat with only 9 individual parts: one hull, four circles, one lower mast, one sail, one upper mast with a flag, and one figurehead at the front of the boat.

In FIG. 3, an embroidery software assigns letters A-I to individual parts, then automatically generates an initial sequence of embroidery, for example B-C-E-F-G-D-H-I-A. FIG. 4 also shows a strip of icons illustrating the individual parts of the embroidery image. Only parts of which are visible in this example.

In FIG. 4, it would be difficult to know, for example, if icon 4 corresponds to I, H, G, or F in FIG. 3. As a practical matter, the strip of individual parts shown in the icons can grow significantly large because typical embroidery images contain tens or hundreds of individual parts, as in FIG. 1. This makes the locating of individual design parts even more challenging and time-consuming.

First, selecting any part of an embroidery image that contains the same color will generate an image of the individual parts of the embroidery image that contain that color. Then, assuming that the sailboat represents one part of a larger embroidery image, and that all individual parts of the sailboat is one color, the software would generate entry points and exit points for each individual part of the sail boat as shown in FIG. 5. The entry and exit points should be indicated in a manner different from the references used to indicate the individual parts to avoid confusion. See, for example, the flower image in FIGS. 10, 11, and 13. In this way, the user would have a clear indication of the automatically generated sequence of the embroidery image.

In FIG. 5, the user would be able to see the arrow between part "I" to part "A" is too long. This is made even more visible if the arrow is a different color from the rest of the design. The user may decide to eliminate the thread between part "I" and part "A" by changing the sequence to A-B-C-E-F-G-D-H-I.

With existing software, a user would have to search through the strip of individual design parts icons for a specific part of the design and move it to a chosen position within the strip. In this case, the user would have to find and pick, for example, part "B" in the icon strip and move it after "A"; then pick "C" and move it after "B;" then pick "E" and move it after "C;" and so forth until the sequence meets the users preferences. Ambiguity as to which icon of the strip corresponds to icons F, G, H, I, as well as the need to continuously scroll through the strip, especially on a small laptop screen, would make the process tedious for the software user. In addition, the user would have to manually adjust the entry and exit points of all pieces after the rearrangement.

In the current method, the user simply "draws" the sequence that they would like the software to output to the embroidery machine, while at the same time using the representation of the whole design. Therefore, the user could just re-arrange the two parts that would look "wrong" according to the user's preferences just by pressing the mouse button inside part "A," moving the mouse to part "B" with the key pressed down (drag) and releasing the mouse key within part "B" as shown in FIG. 6. This would modify the sequence to A-B-C-E-F-G-D-H-I, having moved part "B" together with any parts following part 'B' that would not need a thread trim. FIG. 7 then shows an example of a re-arranged initial sequence where the user has chosen to connect individual parts based on proximity (closeness) of the individual parts.

In a simpler example, assume there are four parts, A B C and D. An arrow is displayed from A to B, from B to C and from C to D. To move the C after the A the user draws a new arrow from A to C. When the mouse is released, the user will then see arrows from A to C, from C to D and from D to B.

After all entry and exit points have been recalculated by the software, the output would look like FIG. 7. Note that the present method does not require the user to set the sequence for each and every part of the embroidery image. The user need only specify whatever pairs of parts do not have the correct sequence according to the users preferences.

In another example, FIG. 8 illustrates a flower in the colors green, red, and yellow. A user may select an initial sequence of embroidery or instruct the software to do so automatically, as shown in FIG. 9, numbers 1-10. FIG. 9 shows the initial sequence as "left stem, right leaf, left leaf, right stem" (1-2-3-4). Suppose the user wants to rearrange this initial sequence to embroider the green parts in an optimal sequence that eliminates visible connecting stitches. The user decides that the optimal sequence should be "right leaf, right stem, left stem, left leaf" (2-4-1-3 in FIG. 9).

To do this, the user first activates a re-arrange tool and selects all of the green parts (1-4) of FIG. 9. Referring to FIG. 10, the software tool will then illustrate the initial sequence of embroidery for the green parts using arrows, where the symbol indicates the entry point where the first stitch of the green parts is located, and the symbol indicates the exit points for each of the green parts based on the initial sequence.

Next, the user can re-arrange the initial sequence by placing the mouse/cursor over one of the green individual parts. In FIG. 11, the user places the cursor on the right leaf, presses the mouse button/cursor and drags the mouse/cursor to the right stem 9. This will re-arrange the initial sequence of "left stem, right leaf, left leaf, right stem" to "left stem, right leaf, right stem, left stem" indicated as the new sequence order 1-4 in FIG. 12. This would result in a secondary sequence but not enough to achieve the optimal sequence.

To achieve the optimal sequence of "right leaf, right stem, left stem, left leaf," the user takes an additional step by placing the mouse/cursor over the right stem and dragging the mouse/cursor to the left stem and releasing the mouse/cursor, as shown in FIG. 13. In this way, the optimal sequence of "right leaf, right stem, left stem, left leaf" is achieved, as illustrated in FIG. 14 as new numbers 1-2-3-4.

The method can be described in further detail as follows:

1. A method for displaying and intuitively editing the entry points, exit points and sequence of sequential same-colored individual parts of an embroidery design using a computer pointing device and computer software, comprising the following steps:
   a. Computer software containing an embroidery design, comprised of many individual parts, of several different colors. Initially all entry and exit points start flagged as automatic and the manual trim flag is set to false.
   b. The user clicks inside one of the individual parts (part0) using a pointing device P1.
   c. The software tool generates a list of same color individual parts, that are immediately before or after the first individual part that would share the same color as the first individual part
   d. The user draws all the individual parts in list L1 on the computer screen with a thick colored line around them to highlight them from the rest of the embroidery design.
   e. Iterating through all the parts in the L1 list in pairs (first with second, second with third, third with fourth and so on), naming them part1 and part2, then iterating through all the entry and exit points of part1 and part2, spaced at one tenth of a millimeter, to find the closest pair of points (p1 of part1 and p2 of part2) and if the distance p1 to p2 is below a global setting by the user (g1), in the range of 1 mm to 12 mm usually 2.5 mm, the exit point of part1 will be set to p1 if p1 did not have an exit point flagged as manual and the entry point of part2 will be set to p2 if p2 did not have an entry point flagged as manual.
   f. Iterating through all parts in the L1 list, for each part (part7), if the entry and/or the exit point is not calculated in step 1.e and they are not flagged as manual, apply the following rules:
      i. If the entry point of part7 was not calculated, add a marker to the part7, that when the design will be exported to an embroidery machine in whatever format the embroidery machine supports, to include a special command to trim the thread before part7. Otherwise clear any marker that existed in part7.
      ii. If the entry point of part7 was calculated, but the exit point was not, iterate through all the points of the part7, again with one tenth of a millimeter spacing, select the point that is further away from the entry point and set it as exit point of part7.
      iii. Similarly, if the exit point of part7 was calculated, but the entry point was not, iterate through all the points of part7, again with one tenth of a millimeter spacing, select the point that is further away from the exit point and set it as entry point of part7.
      iv. If both entry and exit points of part7 were not calculated, iterate through all the possible pairs of points of part7, again with one tenth of a millimeter spacing, select the pair of points (p3, p4) that are the furthest away, and set p3 as entry point and p4 as exit point of part7. The order does not matter.
   g. Getting all the parts in the list L1 in pairs (first with second, second with third, third with fourth and so on) naming them part 3 and part4, and displaying
      i. Special icons showing the position of the entry and exit point of the part 3
      ii. Special icons showing the position of the entry and exit point of the part 4
      iii. An arrow between the exit point of part 3 and the entry point of part 4, whose color will show if the thread that would connect the parts will be trimmed or not (distance between exit point of part3 and entry point of part4 is above g1 or manual override flag is on, on part4)
   h. Waiting for the user to:
      i. Select the end of the operation—here the method is complete ii. Select any part other than the ones in list L1. At that point the software clears the list L1, sets part0 to the one clicked and restarts from step 1.c iii. Do a drag-drop operation starting on top of any entry or exit point displayed (belonging to part9). At that point the entry or exit point of part9 is set to the new, specified by the user position (where the user released the mouse) its manual flag is set and the method goes to step 1.e where the exit point of the part preceding part9 and the entry point of the part following part9 in L1 list, if they exist, will also be recalculated.

iv. Do a drag-drop operation from one part in L1 (part5) to another part in L1 (part6)

1. Create a list L2, add part6 in L2
2. For each of the parts in L1 which follow part6, named part8
   a. If part8 has a manual trim flag, or its distance to the previous item is above g1 stop the iteration
   b. If part8 is in fact part5 stop the iteration, clear list L2 and add only part6 to the list
   c. Otherwise add part8 to list L2
3. If L2 contains only part6 and part6 is immediately after part5 do nothing and g0 to step 1.h
4. Move the parts in list L2 from their original position in the sequence to just after part5, keeping their order in L2, so that they will be embroidered immediately after part5
5. If one key modifier (one of ALT/CTRL/SHIFT/OPTION/COMMAND keyboard keys depending on the user keyboard and operating system) was kept down on the keyboard during the drag operation, depending on the key modifier, do:
   a. Clear the exit point of part5 and the entry point of part6 to manual override and will clear them (exit point of part5 and entry point of part6)
   b. If key modifier A is kept down (for example COMMAND/CTRL) the software will assign the exit point of part5 and the entry point of part6 using the 1.f procedure
   c. If key modifier B is kept down (for example OPTION/ALT) the software will assign the exit point of part5 and the entry point of part6 using the 1.e procedure but with g1 set to infinity
6. If no key modifier is pressed, set the exit point of part5 and the entry point of part6 to automatic. Set also the last item's exit point in list L2, if it is different to part6, to automatic.
7. Continue at step 1.e, so that the parts that were originally before the first item in L2 and after the last item in L2, the part that originally followed part5, part5 itself and items in L2 list will get their entry/exit points recalculated and the method will wait for the user to give the next command (step 1.h).

What is claimed:

1. A method for rearranging an initial sequence of same-color individual parts of an embroidery image containing a plurality of colors, using a computer pointing device and a software tool, to obtain an optimal sequence of embroidery that minimizes the appearance of stitching on an embroidered product with an embroidery machine, the method comprising the following steps:

a. software tool displays the embroidery image on a computer screen and illustrates the initial sequence of embroidery using arrows, entry points, and exit points;

b. user clicks on a first individual part of the embroidery image;

c. the software tool generates a list of same color individual parts, that are immediately before or after the first individual part that would share the same color as the first individual part;

e. user re-arranges the initial sequence of embroidery to achieve an optimal sequence of embroidery that minimizes the appearance of stitching on the embroidered product by dragging a same color individual part to another same color individual part to achieve a closest connection between same color individual parts; and f. repeating the same process for other individual parts of the embroidery image if a plurality of other individual parts are to be embroidered in a different color.

2. The method of claim 1, further comprising the step of drawing a line around the same color individual parts in order to separate said individual parts from the rest of the embroidery image.

3. The method of claim 1, wherein the list is arranged in pairs of same color individual parts, and exit and entry points are arranged on same color individual parts to find the closest pair of entry and exit points between same color individual parts.

4. The method of claim 3, wherein, if the distance between an exit point of one same color and the entry point of another same individual part is below a global setting by the user, the exit and entry points will be automatically accepted unless flagged as manual by the user.

5. The method of claim 4, wherein the global setting by the user is between 1 mm to 12 mm.

6. The method of claim 5, wherein a default setting by the software is 2.5 mm.

7. The method of claim 3, wherein, if the distance between an exit point of one same color and the entry point of the following/next in line same individual part is not below a global setting by the user, and is not flagged as manual, a marker is added to instruct the embroidery machine to trim a thread.

8. The method of claim 3, wherein, if an entry point of a same color individual part is calculated, but the exit point is not, run through all possible exit points with one tenth of a millimeter spacing, and select the exit point that is furthest away from the entry point of said same color individual part.

9. The method of claim 3, wherein, if an exit point of a same color individual part is calculated, but the entry point is not, run through all possible entry points with one tenth of a millimeter spacing, and select the entry point that is furthest away from the exist point of said same color individual part.

10. The method of claim 3, wherein, if both the entry point and exit point of a same color individual part are not calculated, run through all possible entry and exit points with one tenth of a millimeter spacing, and select the pair of entry points and exit points that are the furthest away.

* * * * *